United States Patent [19]

Li

[11] 4,088,111

[45] May 9, 1978

[54] ARCHERY BOW

[75] Inventor: Yao Tzu Li, Lincoln, Mass.

[73] Assignee: Massachusetts Institute of Technology, Cambridge, Mass.

[21] Appl. No.: 676,829

[22] Filed: Apr. 14, 1976

[51] Int. Cl.[2] ..... F41B 5/00

[52] U.S. Cl. ..... 124/23 R; 124/86

[58] Field of Search ..... 124/23 R, 86, 24 R, 124/41 A, 23 A

[56] References Cited

U.S. PATENT DOCUMENTS

| | | | |
|---|---|---|---|
| 126,734 | 5/1872 | Morton | 124/123 R |
| 1,810,335 | 6/1931 | Barnhart | 124/123 R |
| 1,960,477 | 5/1934 | Cowdery | 124/23 R |
| 2,000,832 | 5/1935 | Fisher | 124/23 R |
| 2,116,650 | 5/1938 | Zima | 124/23 R |

FOREIGN PATENT DOCUMENTS

| | | | |
|---|---|---|---|
| 658,441 | 10/1951 | United Kingdom | 124/23 R |

*Primary Examiner*—George J. Marlo

*Attorney, Agent, or Firm*—Arthur A. Smith, Jr.; Gordon R. Williamson

[57] ABSTRACT

An archery bow having a pair of elastic limbs at least one of the limbs storing potential energy in the deformation of its cross sectional shape as the bow is drawn as well as in its bending mode in the plane of the bow.

17 Claims, 14 Drawing Figures

FIG. 3
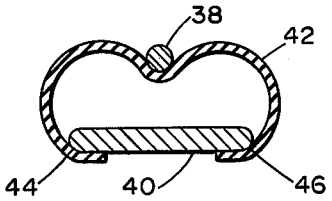
FIG. 4
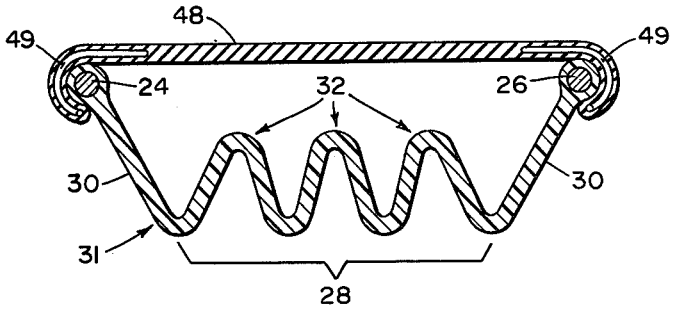
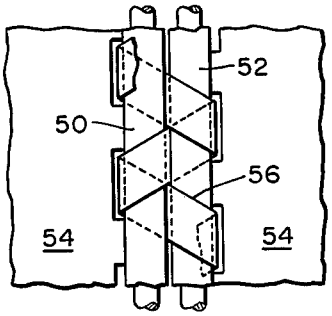
FIG. 7
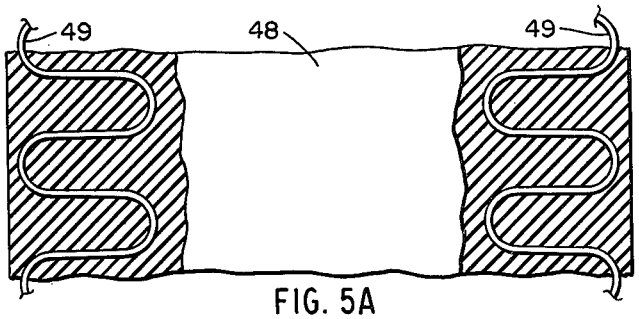
FIG. 5A
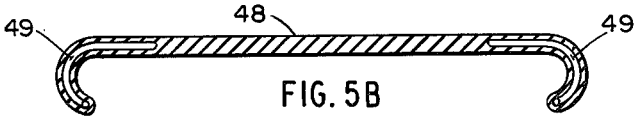
FIG. 5B
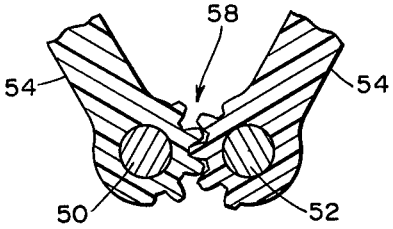
FIG. 8
FIG. 6
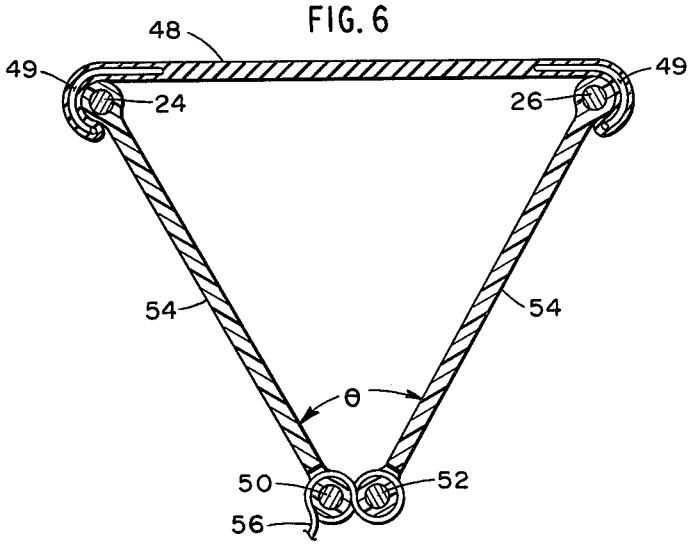
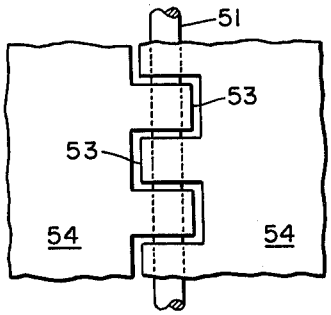
FIG. 11

ARCHERY BOW

BACKGROUND OF THE INVENTION

The invention relates to an improved archery bow and more specifically to a bow having characteristics such that the force required to hold said bow in a fully drawn position is less than required at intermediate positions.

Early bows consisted of a flexible beam structure with a bowstring attached to the beam tips. As the bow was drawn, the force required increased as the draw increased due to the changing leverage geometry. More recently, bows known as compound bows have come into use. Such bows have structure coupling the bowstring with the beam to achieve a mechanical advantage such that the force required to hold the bow at full draw position is less that that required at intermediate draw positions. Typically, these structures consist of, or include, items such as cams and pulleys to vary the effective leverage as the bowstring is drawn. The resulting bow arrangement is complex and may result in multiple bowstring paths rather than one simple bowstring section connecting the tips of the limbs of the bow.

It is an object of the present invention to provide an archery bow having limbs which provide greater force at intermediate draw than at full draw without requiring complex structures to couple the bowstring to the limbs. It is also an object of the present invention to provide an archery bow which will provide substantially greater stored energy at full draw than that provided by a standard simple bow requiring the same force to hold the bow at full draw position.

SUMMARY OF THE INVENTION

These and other objects are achieved through the use of a bow limb having an elastically constrained cross sectional configurations which change as the bow is drawn.

DRAWINGS

The invention is more fully described in the following description of specific embodiments in conjunction with the following drawings wherein.

Figure 2:
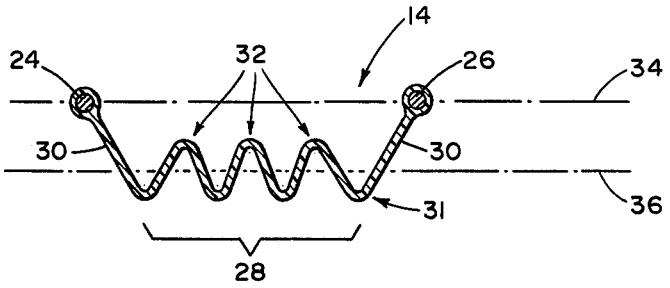
FIG. 2 is a view taken at 2—2 of FIG. 1.
Figure 10:
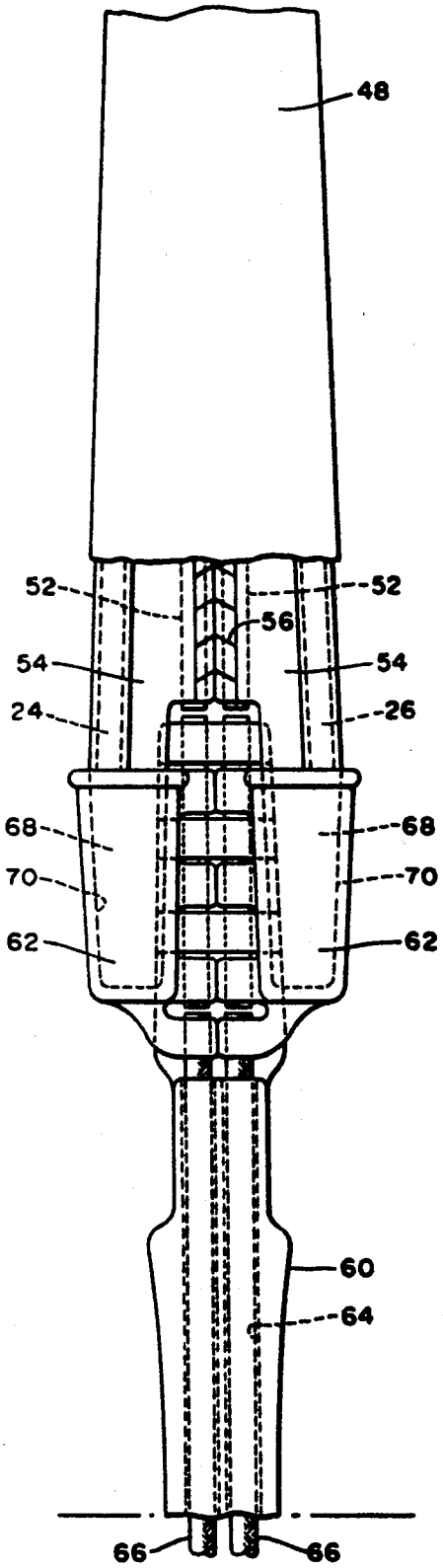
Figure 9:
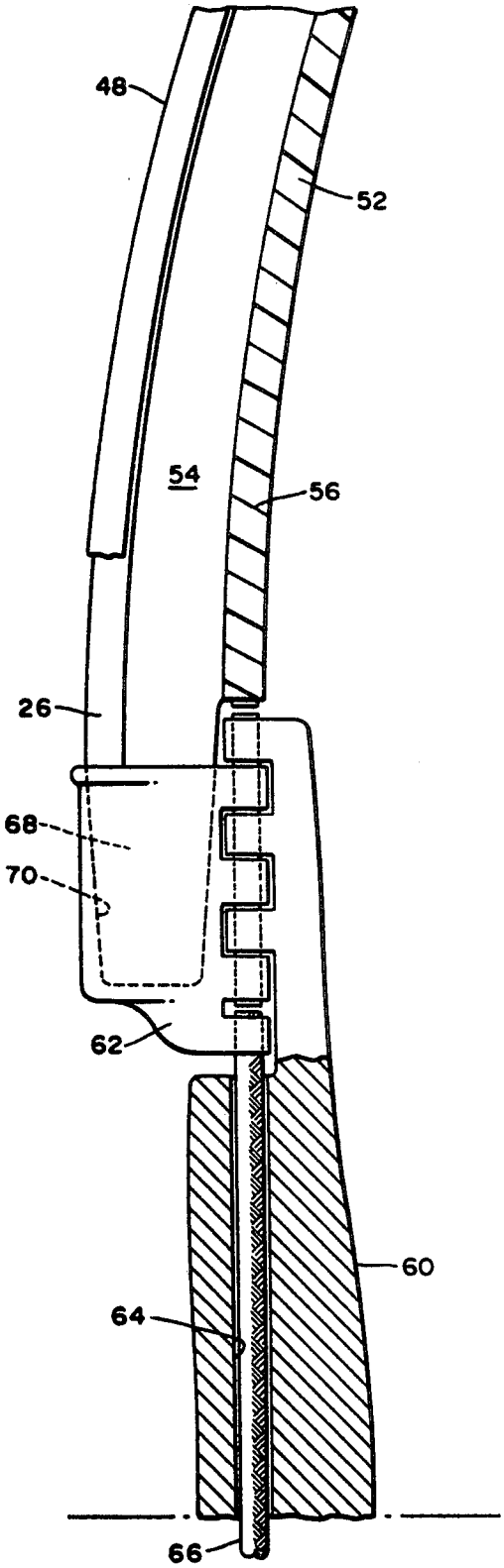

FIGS. 3, 4, and 6 are cross sectional views, similar to FIG. 2, of alternative bow constructions in accordance with the present invention;

FIGS. 5A and 5B are broken away plane and sectional views of an element of the bow illustrated in FIGS. 4 and 6;

FIG. 7 is a fragmentary perspective view illustrating constructional features of the embodiment of FIG. 6;

FIG. 8 is an enlarged sectional view illustrating an alternative constructional arrangement of the embodiment of FIG. 6;

FIG. 9 is a side elevation of portions of the handle limbs of a bow having the construction illustrated in FIG. 6;

FIG. 10 is a front elevation of the bow illustrated in FIG. 9; and

FIG. 11 is a view similar to FIG. 7 of an alternative construction.

DETAILED DESCRIPTION OF PARTICULAR PREFERRED EMBODIMENTS

Figure 1:
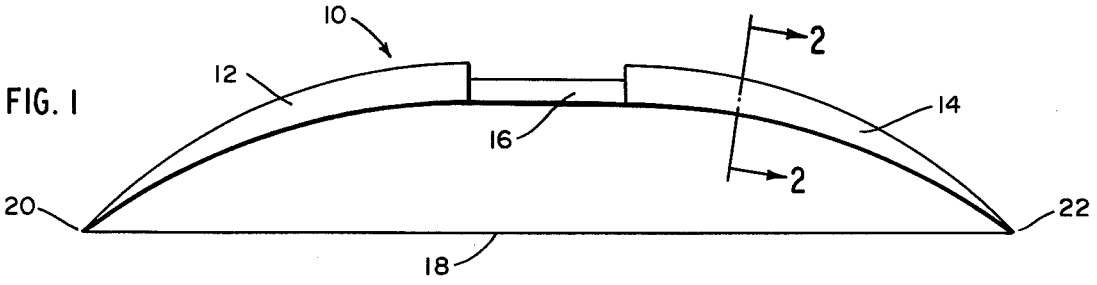
FIG. 1 is a side view of a strung bow in rest position.

FIGS. 1 and 2 are somewhat schematic illustrations of a bow including features according to the present invention. The bow comprises a beam 10 including a pair of limbs 12 and 14, and an intermediate handle 16, attached to the limbs in a manner discussed below. A bowstring 18 is secured directly to the limb tips 20 and 22. Each of the limbs 12 and 14 is essentially symmetrical about a longitudinal axis of the beam 10 (see FIG. 2). This axis of the beam 10 and the bowstring 18 together define the bow's plane.

Referring to FIG. 2, each of the limbs includes a pair of elongate tension members 24 and 26, (e.g., metallic rods) disposed parallel to the limb axis, and an intermediate compression member 28. Each of the tension members 24, 26 is connected to the compression member 28 by a connecting panel 30 which, in the embodiment illustrated, is a portion of a web 31 integral with the compression member 28. The integral web defining the compression member 28 and the connecting members 30 may be formed in a variety of ways (e.g., laminates of wood, plastics, fiberglass, etc.) to provide a resiliently deformable member in which the members 24, 26 are preferably imbedded. Corrugations 32, in the portion of the web 31 comprising the compression member 28, give the compression member rigidity along the longitudinal axis of the beam 10, as is required to prevent buckling when it is stressed as the bow is drawn (see FIGS. 1A and 2A). The corrugations 32 also provide resilient flexibility in the lateral direction of the limb, thereby permitting deformation of the web 31 under the influence of forces exerted by the tension members 24 and 26 and the compression member 28 as the bow is drawn. As is explained in greater detail below, such deformation is an important feature of the present invention and is a mechanism for storing energy in lateral deformation of the limb (in addition to the conventional deformation of the limb in the bow's plane).

Figure 1A:
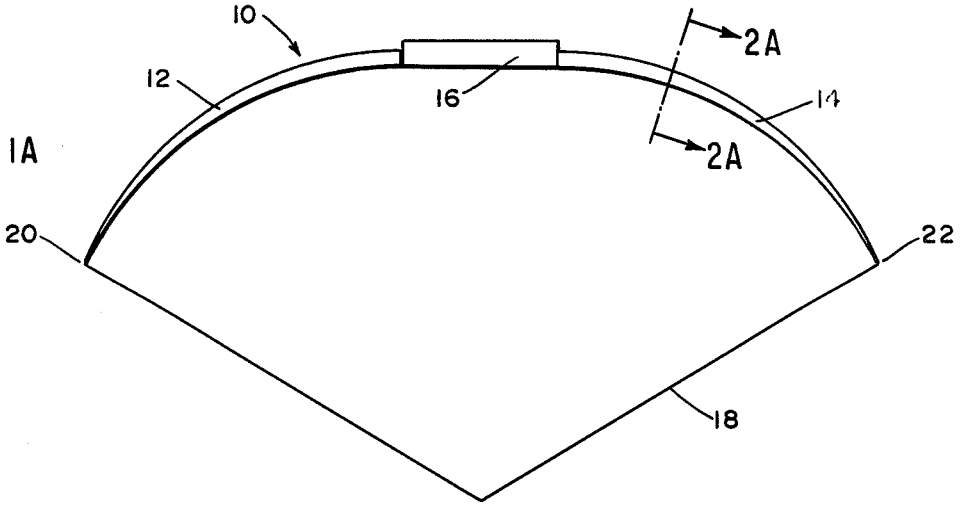
FIG. 1A is a view similar to FIG. 1 of the bow in a drawn position.
Figure 2A:
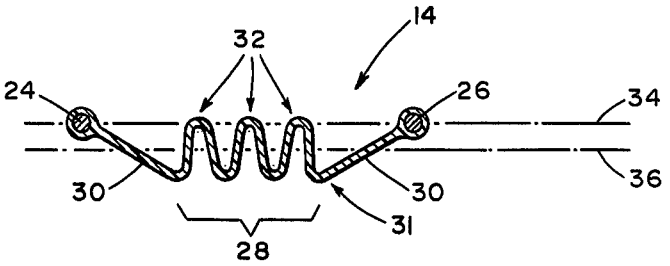
FIG. 2A is a view taken at 2A—2A of FIG. 1A.

This deformation transverse to the beam axis is evident from a comparison of FIGS. 1 and 1A and of FIGS. 2 and 2A. Referring in particular to FIGS. 2 and 2A, it will be seen that not only are the corrugations laterally compressed in the drawn condition of the bow, but the angles between the connecting webs 30 and the compression member 28 have changed. This is evident from a comparison, between FIGS. 2 and 2A, of the positions, relative to each other, of reference lines 34 and 36 passing through, respectively, the centers of the tension members 24, 26 and the center of the compression member 28. It will be evident to those skilled in the art, therefore, that, in the drawn condition of the bow (illustrated in FIGS. 1A and 2A), energy is stored by the various deformations of the integral web 31 defining limb portions 28 and 30, as well as by the longitudinal strains produced in the tension members 24 and 26 in the compression member 28.

Because of the storage of potential energy in a deformation of the bow limbs in cross sections perpendicular to the axis of the bow beam 10, a bow according to the present invention can be constructed such that the force required to maintain the bow in a fully drawn configuration (as in FIG. 1A) is less than the force required to maintain the bow in a partially drawn configuration.

FIGS. 3–5 are cross sectional views, similar to FIG. 2, of unstressed bow limbs illustrating alternative embodiments of a bow constructed in accordance with the present invention. Referring first to FIG. 3, there is shown a tension member 38 in the form of a flexible cable or rod, a flat compression member 40, and a flexible membrane 42 disposed intermediate the tension member 38 and the compression member 40 and secured in a leakproof seal along the dges 44 and 46 of the compression member 40. With this arrangement, as the bow is drawn the movement of the tension member 38 toward the compression member 40 will cause the deformation of the membrane 42 and the resultant compression of the air (or other compressible fluid) trapped in the volume defined by the membrane 42 and the compression member 40.

The embodiment of FIG. 4 is very similar to that of FIG. 2, with the only difference being the provision of an elastic (e.g., rubber) membrane 48 secured at its opposite edges to the tension members 24 and 25. The membrane 48, which preferably extends the full length of the bow limb, but which may be segmented into a series of periodically spaced strips, will store additional energy in the transverse energy storage mode of the bow limb as the limb deflects to a configuration such as shown in FIG. 2A. Preferably, the membrane 48 is secured to the bow limb by bent embedded steel wire 49, which anchors around the members 24 and 26. The wire 49 can be imbedded in a serpentine pattern adjacent the lateral edges of membrane 48, as shown in FIG. 5A. Bending of the imbedded wire 49 results in a membrane cross section, as shown in FIG. 5B, facilitating easy sliding of the membrane longitudinally over the bow limbs.

The use of the membrane 48 to store energy is also provided in the embodiment of FIG. 6, a presently preferred embodiment. In that embodiment, however, a pair of side-by side, steel rod compression members 50, 52 are provided with each being linked to a steel rod tension member 24 or 26 by a relatively rigid connecting web 54 (similar to the web 31 defining connecting portion 30 of the structures illustrated in FIGS. 2 and 4). Drawing of the bow will cause a clockwise rotation of compression member 52 and a counter-clock-wise rotation of compression member 50 (e.g., angle $\theta$ increasing from about 60° to about 170°) with an attendant increased separation of the tension members 24 and 26 and storage of energy in the stretched membrane 48. The compression members 50 and 52 must be maintained in alignment with each other and will bear against each other as they are pressed together in reaction to the stretching of membrane 48. One arrangement for maintaining the compression members with proper alignment and relationship to each other is illustrated in FIG. 7. In this arrangement an integral ribbon or strap 56 of flexible material (e.g., fabric) is wrapped in an alternating pattern around the cylindrical compression members 50 and 52.

In the embodiment of FIG. 11, a single hinge pin 51 links meshed hinge portions 53 of webs 54. An alternative arrangement is illustrated in FIG. 8 and involves the provision of meshing gear teeth (indicated at 58 of FIG. 8) provided on the facing portions of each of the compression members 50 and 52. Preferably, the gear teeth have a pitch diameter equal to the diameter of the cylindrical bearing surfaces on the members 50 and 52 in order to provide a smooth rotational motion of the members 50 and 52 as the bow is drawn.

As will be apparent to those skilled in the art, various modifications of the embodiments illustrated, as well as the provision of different embodiments entirely, are possible while still achieving the benefits of the present invention. As an example, one could provide a single unitary panel, of crescent shape and having a cross section as shown in FIG. 6, to replace the three members 24, 50 and 54 and another similar panel to replace the three members 26, 52, 54. Another modification would be to change the orientation of the limbs. Thus, for example, in the embodiment illustrated in FIG. 6, the "V" formed by members 54 could point toward the front or a side of the bow, as well as toward the rear (i.e., toward the bowstring).

FIGS. 9 and 10 illustrate in somewhat more detail the limbs of a preferred bow constructed in accordance with the present invention and the manner in which such limbs are secured to the bow's handle. The limb construction illustrated in FIGS. 9 and 10 is the same as the embodiment illustrated in FIGS. 5 and 6. The limbs are secured to a handle structure which consists of a base 60 and hinges 62. The base 60 includes an internal channel 64 for receiving flexible shafts 66 secured to the upper and lower hinges 62. The flexible shafts 66 couple the upper and lower bow limbs to each other, thus assuring concurrent transverse deformation of each limb as the bow is drawn. (Alternatively, the upper and lower limbs could be integral with an encircling handle secured thereto so as to permit the beam deformation in accordance with the present invention.)

Referring still to FIGS. 9 and 10, the beam limbs may be attached to the hinges 62 in any convenient manner. The illustrated tapered fitting of limbs stubs 68 in hinge recesses 70 has the advantage of convenient bow assembly and disassembly.

While particular preferred embodiments of the present invention have been illustrated in the accompanying drawings and described in detail herein, it will be apparent to those skilled in the art that other embodiments are within the scope of the invention and the appended claims.

I claim:

1. An archery bow comprising a pair of elastic limbs and a bowstring attached to the tips of said limbs, said limbs and said bowstring defining a bow plane, said limbs defining a longitudinal axis through said limbs in said bow plane, at least a first of said limbs having a shape, in a cross section perpendicular to said axis, that changes substantially in response to forces experienced by that limbs as said bowstring is drawn from its rest position; whereby energy is stored, in the drawn bow, by said limb shape change as well as by bending of said limbs in said bow plane.

2. An archery bow according to claim 1 wherein the cross sectional shape of said limp changes as a function of the bending of said limb such that the rate of energy storage in said limb decreases for increased bending over a range of additional bow draw, whereby less force is required to hold the bow with a draw at the end of that range than with a draw within that range.

3. An archery bow according to claim 1 wherein both of said limbs have a shape, in a cross section perpendicular to said axis, that changes in response to the forces experienced by the limbs as said bowstring is drawn from its rest position.

4. An archery bow according to claim 3, said bow further comprising a handle intermediate said limbs and secured thereto, said handle having a fixed cross section.

5. An archery bow according to claim 4 wherein said handle is connected to said limbs through hinges.

6. An archery bow according to claim 5 wherein the first and second hinges engaging the first and second bow limbs are connected by means that transmit forces deforming said limb cross sectional shapes.

7. An archery bow according to claim 6, said means connecting said first and second hinges comprise flexible shaft means extending through said bow handle.

8. An archery bow according to claim 1 wherein said first limb comprises a plurality of elongate members including at least one compression member and at least one tension member, said compression member disposed substantially parallel to the plane of said bow and experiencing compressive force as the bow is drawn, said tension member being disposed substantially parallel to the plane of said bow and experiencing tensile forces as the bow is drawn, said first limb further comprising connecting means that interconnects said elongate members.

9. An archery bow according to claim 8 wherein said connecting means comprises a flexible membrane having a leak proof seal around its edges and enclosing a compressible fluid.

10. An archery bow according to claim 9 wherein said compression member comprises a plate of predetermined width in a direction perpendicular to the bow plane, said flexible member secured along opposite edges of said compression member, said tension member bearing against the outer surface of said flexible member.

11. An archery bow according to claim 8 wherein said first limb comprises first and second tension members disposed on opposite sides of said longitudinal axis, said compression member being disposed adjacent said axis, said connecting means comprising deformable web means secured to each of said tension members and to said compression member.

12. An archery bow according to claim 11 wherein said connecting means further include an elastic member linking said first and second tension members.

13. An archery bow according to claim 11 wherein said compression member and said web means are formed as an integral web of deformable material.

14. An archery bow according to claim 13 wherein the portion of said integral web that defines said compression member is corrugated.

15. An archery bow according to claim 11 wherein first and second compression members are provided in a side-by-side relationship, said bow further comprising means for securing said compression members to each other while permitting relative rotation therebetween, said connecting means including an elastic linking said first and second tension members.

16. An archery bow according to claim 15 wherein said means for securing said first and second compression members to each other comprise a flexible web having web portions encircling each of said first and second compression members.

17. An archery bow according to claim 15 wherein said first and second compression members are provided with intermeshing gear teeth.

* * * * *